US009181648B2

(12) United States Patent
Bringewatt et al.

(10) Patent No.: US 9,181,648 B2
(45) Date of Patent: Nov. 10, 2015

(54) METHOD FOR TREATING LAUNDRY AND INLINE WASHING SYSTEM

(75) Inventors: Wilhelm Bringewatt, Porta Westfalica (DE); Engelbert Heinz, Vlotho (DE)

(73) Assignee: Herbert Kannegiesser GmbH, Vlotho (DE)

( * ) Notice: Subject to any disclaimer, the term of this patent is extended or adjusted under 35 U.S.C. 154(b) by 45 days.

(21) Appl. No.: 13/423,233

(22) Filed: Mar. 18, 2012

(65) Prior Publication Data

US 2012/0240342 A1 Sep. 27, 2012

(30) Foreign Application Priority Data

Mar. 22, 2011 (DE) ..... 10 2011 014 730
Apr. 16, 2011 (DE) ..... 10 2011 017 345

(51) Int. Cl.

| | |
|---|---|
| ***D06F 31/00*** | (2006.01) |
| ***D06F 35/00*** | (2006.01) |
| ***D06F 47/00*** | (2006.01) |
| ***D06F 47/02*** | (2006.01) |
| ***D06F 47/04*** | (2006.01) |
| ***D06F 47/06*** | (2006.01) |
| ***D06F 47/08*** | (2006.01) |
| ***D06F 49/00*** | (2006.01) |
| ***D06F 51/00*** | (2006.01) |
| ***D06F 95/00*** | (2006.01) |

(52) U.S. Cl.

CPC ..... *D06F 31/005* (2013.01); *D06F 35/006* (2013.01); *D06F 47/00* (2013.01); *D06F 47/02* (2013.01); *D06F 47/04* (2013.01); *D06F 47/06* (2013.01); *D06F 47/08* (2013.01); *D06F 49/00* (2013.01); *D06F 51/00* (2013.01); *D06F 95/00* (2013.01)

(58) Field of Classification Search

CPC ..... G06F 49/00; G06F 51/00; G06F 95/00
USPC ..... 68/12.14
See application file for complete search history.

(56) References Cited

U.S. PATENT DOCUMENTS

| | | | | |
|---|---|---|---|---|
| 2002/0116770 | A1* | 8/2002 | Mehrmann et al. | 8/158 |
| 2004/0069021 | A1* | 4/2004 | Bringewatt et al. | 68/21 |
| 2008/0289119 | A1* | 11/2008 | Bringewatt et al. | 8/159 |

* cited by examiner

*Primary Examiner* — Michael Barr
*Assistant Examiner* — Levon J Shahinian
(74) *Attorney, Agent, or Firm* — Laurence P. Colton; Smith Risley Tempel Santos LLC

(57) ABSTRACT

A method for treating laundry and an inline washing machine that makes provision for water to be removed from the laundry selectively only in a water-removal press or in a water-removal press and a laundry centrifuge. Delicate items of laundry are subjected only to preliminary pressing in the water-removal press while water is then completely removed in the laundry centrifuge. In this way, a water-removal press can always be permanently arranged downstream of the washing machine and all the laundry, including delicate laundry, can pass through the water-removal press.

12 Claims, 2 Drawing Sheets

METHOD FOR TREATING LAUNDRY AND INLINE WASHING SYSTEM

STATEMENT OF RELATED APPLICATIONS

This patent application claims priority on and the benefit of German Patent Application No. 10 2011 014 730.6 having a filing date of 22 Mar. 2011 and German Patent Application No. 2011 017 345.5 having a filing date of 16 Apr. 2011.

BACKGROUND OF THE INVENTION

1. Technical Field

The invention relates to a method for treating laundry, in particular washing laundry, removing water from laundry and possibly drying laundry, such as a method for treating laundry, with the laundry being at least washed in a washing machine and at least some water being removed from said laundry in a subsequent water-removal press. The invention also relates to an inline washing system such as an inline washing system having a washing machine and a water-removal press which is arranged downstream of said washing machine.

2. Prior Art

Especially in commercial laundries, water is removed from laundry after said laundry has been washed and said laundry is then dried, mangled, finished and/or folded, depending on the type of laundry. Items of clothing are finished after water has been removed. Flat laundry is mangled after water has been removed. Other types of laundry, for example terry toweling, is only dried and then folded.

Water is removed from items of clothing in different ways depending on the type of clothing. For example, water is not removed from items of clothing in water-removal presses but rather in laundry centrifuges—also called spin-dryers. Different items of laundry can be washed in the same washing machine. However, after washing, water has to be removed from the items of laundry either in the water-removal press or in the laundry centrifuge, depending on whether the items of laundry are delicate or less delicate items of laundry. The water-removal presses and laundry centrifuges are generally fixedly associated with a specific washing machine. This requires a plurality of inline washing systems with in each case at least one washing machine which has an associated water-removal press and at least one further washing machine which has an associated laundry centrifuge. The items of laundry are then washed in that washing machine which is followed by the water-removal device which is suitable for the items of laundry. However, this has an adverse effect on flexibility in, in particular, commercial laundries if delicate and less delicate laundry is not to be washed in a balanced proportion.

BRIEF SUMMARY OF THE INVENTION

The invention is based on the object of providing a method for treating laundry and an inline washing system which can be used in a flexible manner.

A method for achieving this object is a method for treating laundry, with the laundry being at least washed in a washing machine and at least some water being removed from said laundry in a subsequent water-removal press, wherein water is removed from the laundry selectively only in the water-removal press or in the water-removal press and then in a laundry centrifuge. This method makes provision for water to be removed from the laundry selectively only in the water-removal press or in the water-removal press and then in a laundry centrifuge. In this case, the laundry passes through the water-removal press in each case. Therefore, a washing machine having a laundry press arranged fixedly behind it can be used for all types of laundry, in particular including items of clothing. However, although delicate items of laundry can also pass through the water-removal press, water is ultimately removed from them only in the laundry centrifuge. Therefore, water is completely removed from delicate laundry in the laundry centrifuge. In this context, "complete" removal of water is understood to mean removal of water to the maximum possible extent, although all the liquid may not have been removed from the laundry in the process.

When water is removed from the laundry in the water-removal press and in the laundry centrifuge, delicate laundry is preferably subjected only to preliminary pressing or preliminary water removal in the water-removal press. In the process, said delicate laundry is subjected to mechanical loading only in such small amounts that said delicate laundry is not damaged in the water-removal press.

In an advantageous refinement of the method, when water is removed only in the water-removal press, a maximum pressing force is applied to the items of laundry in said water-removal press. In contrast, when water is removed from the laundry both in the water-removal press and in the laundry centrifuge, water is removed only with a reduced pressing force in the water-removal press. The reduced pressing force is preferably in the range of from 2% to 15% of the maximum pressing force, in particular in the range of from 3% to 8% of the maximum pressing force. In this case, the pressing force which is exerted on delicate laundry, in particular items of clothing, in the water-removal press and the resulting mechanical loading are so low that said laundry is not adversely affected or damaged during preliminary pressing or else preliminary water removal in the water-removal press.

The method is also advantageously designed such that more water, preferably a maximum amount of water or all water, is removed from the laundry in the laundry centrifuge after preliminary pressing of said laundry in the water-removal press. In this way, as much water as possible can be carefully removed from delicate items of laundry using at least one laundry centrifuge. Generally, water can be removed from delicate items of laundry in the laundry centrifuge just like water can be removed from less delicate items of laundry in a water-removal press.

Items of laundry from which water is ultimately or completely removed in at least one laundry centrifuge are preferably not initially dried in a dryer but rather are directly processed further. Items of clothing, in particular items of workwear, are subjected to finishing treatment in a finisher for this purpose, with the items of laundry, primarily items of clothing, from which water has been completely removed by the at least one laundry centrifuge leaving the finisher in a dry state at the end of the finishing treatment.

One advantageous refinement of the method makes provision for the laundry to be transferred by at least one shuttle from the water-removal press selectively to the at least one laundry centrifuge or to the at least one dryer. In this case, the at least one shuttle serves as a linking element between the water-removal press and the laundry centrifuge or the dryer. The laundry can be fed from the water-removal press selectively to the laundry centrifuge or to the dryer by virtue of the shuttle. As a result, the shuttle functions as a switch.

Another advantageous refinement of the method makes provision for the water-removal press to be unloaded by the shuttle, and also for the shuttle to selectively load the laundry centrifuge or the dryer. As a result, the shuttle acquires additional functions.

An inline washing system for achieving the object cited in the introductory part is an inline washing system having a washing machine and a water-removal press which is arranged downstream of said washing machine, wherein at least one laundry centrifuge is arranged downstream of the water-removal press. In said inline washing system, at least one laundry centrifuge and optionally at least one dryer are arranged downstream of the water-removal press. As a result, more water can be removed from the laundry from the water-removal press selectively in the laundry centrifuge. Laundry from which water can be removed solely in the water-removal press is then immediately dried by the dryer if desired, while water is removed from delicate laundry, which is only subjected to preliminary pressing in the water-removal press, in the laundry centrifuge until complete.

A preferred development of the inline washing system makes provision for one or possibly more shuttles to be provided between the water-removal press and the at least one laundry centrifuge and optionally the at least one dryer. The shuttle can preferably be moved. In this case, said shuttle then serves as a transportation means and as a switch for the laundry leaving the water-removal press. The at least one shuttle can feed the laundry arriving from the water-removal press selectively to the laundry centrifuge or to the dryer and at the same time load and optionally also unload the laundry centrifuge or the dryer. To this end, the at least one laundry centrifuge and the at least one dryer are preferably arranged in a row with, in particular, the loading and/or loading openings facing the same sides. The at least one shuttle can be moved to positions in front of the loading openings of the laundry centrifuge and the dryer in order to be able to selectively load a laundry centrifuge or a dryer with laundry from the water-removal press.

BRIEF DESCRIPTION OF THE DRAWINGS

A preferred exemplary embodiment of the invention will be explained in greater detail below with reference to the drawing, in which.

DETAILED DESCRIPTION TO PREFERRED EMBODIMENTS

Figure 1:
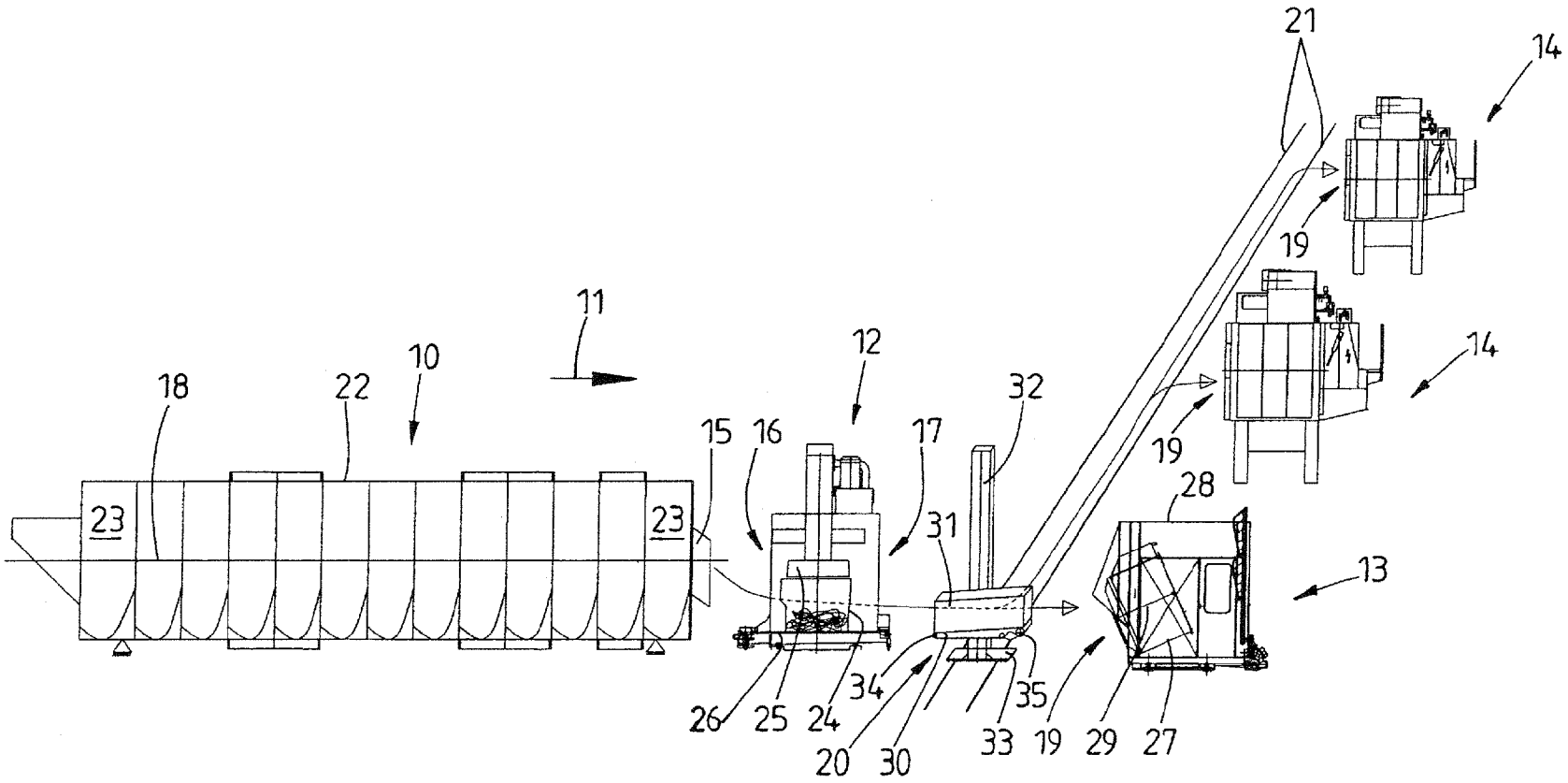
FIG. 1 shows a perspective view of an inline washing system.
Figure 2:
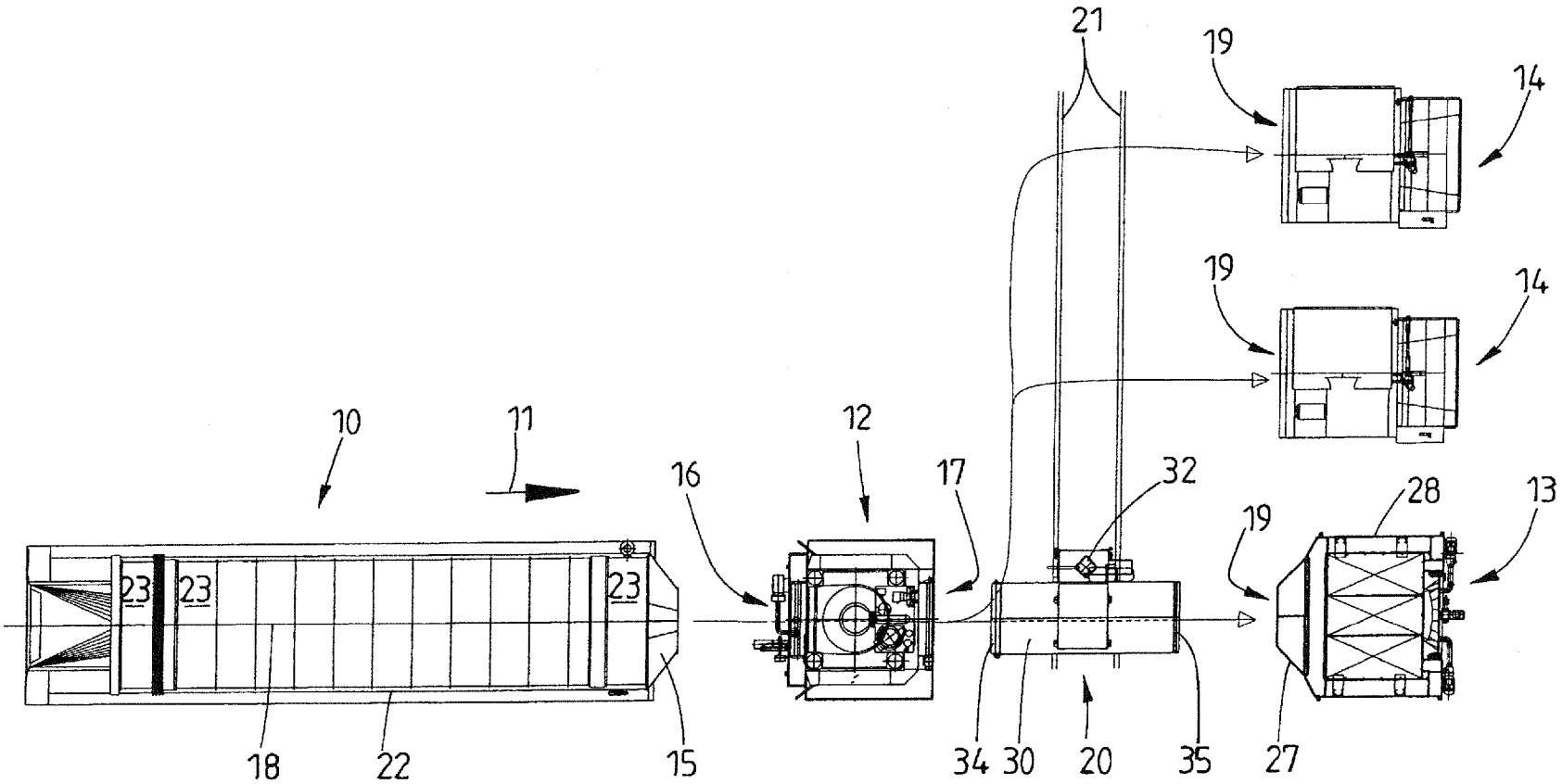
FIG. 2 shows a plan view of the inline washing system of FIG. 1.

FIGS. 1 and 2 show an inline washing system for washing laundry, removing water from laundry and optionally drying laundry. The inline washing system has a tunnel-type washing machine 10 which is followed, in the treatment direction 11, by a water-removal press 12, a laundry centrifuge 13 and, in the shown exemplary embodiment, two dryers 14.

The water-removal press 12 has a loading side 16, which faces an unloading slide 15 at the end of the tunnel-type washing machine 10, and an opposite unloading side 17. The laundry centrifuge 13 and the dryers 14 are arranged in a row which preferably runs transverse to the longitudinal center axis 18 of the tunnel-type washing machine 10, with the loading sides 19 of the laundry centrifuge 13 and the dryers 14 facing in the same direction, specifically toward the unloading side 17 of the water-removal press 12. The laundry centrifuge 13 and the dryers 14 preferably have unloading sides which are opposite the loading sides. However, it is also feasible for the loading sides 19 to simultaneously also be the unloading sides of the laundry centrifuge 13 and the dryers 14.

The unloading side 17 of the water-removal press 12 and the loading side 19 or unloading side of the laundry centrifuge 13 are directly opposite and at a distance from one another, with the centers of the loading side 16 and the unloading side 17 of the water-removal press 12 and the center of the loading side 19 of the laundry centrifuge 13 being situated on an extension of the longitudinal center axis 18 of the tunnel-type washing machine 10 in the exemplary embodiment shown. The centers of the loading sides 19 and possibly the unloading sides of the dryers 14 follow the center of the loading side of the laundry centrifuge 13 at a parallel distance, and therefore these centers are offset in relation to the loading side 19 of the laundry centrifuge 13 in a direction transverse to the longitudinal center axis 18 of the tunnel-type washing machine 10 (FIG. 2).

The inline washing system also has a shuttle which is in the form of a lift belt conveyor 20 in the exemplary embodiment shown. The lift belt conveyor 20 can be moved on straight, parallel rails 21. The rails 21 run transverse or perpendicular to the longitudinal center axis 18 of the tunnel-type washing machine 10. The lift belt conveyor 20 and the rails 21 are arranged between the unloading side 17 of the water-removal press 12 and the loading sides 19 or unloading sides of the laundry centrifuge 13 and the dryers 14 such that the lift belt conveyor 20 can be moved along the rails 21 between said unloading side of the water-removal press and the loading sides or unloading sides of the laundry centrifuge and the dryers, as a result of which the lift belt conveyor 20 can be moved selectively to a position in front of the loading side 19 of the laundry centrifuge 13 or a dryer 14. In the process, the water-removal press 12 can be unloaded by the lift belt conveyor 20, and the laundry centrifuge 13 or one of the dryers 14 can be loaded, and preferably also unloaded, by the lift belt conveyor 20 as required.

The tunnel-type washing machine 10 has a cylindrical drum 22 which can be driven in a rotary manner about a preferably horizontal rotation axis. The rotation axis of the drum 22 is situated on the longitudinal center axis 18 of the tunnel-type washing machine 10. A plurality of chambers 23 which follow one another in the treatment direction 11 are formed in the drum 22 by transversely directed partition walls. The tunnel-type washing machine 10 shown here has thirteen successive chambers 23. However, the tunnel-type washing machine 10 can also have a greater or a fewer number of chambers 23. A prewash zone, a final rinse zone which follows said prewash zone in the treatment direction and has an adjoining rinse zone, and possibly a finishing zone are provided in the drum 22. The individual zones, at least for the most part, have a plurality of chambers 23, it being possible for the number of chambers 23 in the respective zone to differ.

The water-removal press 12 which is arranged downstream of the tunnel-type washing machine 10 is formed in a manner which is known per se. It has a cylindrical press basket 24 into and out of which a ram 25 can be moved by a hydraulic cylinder (not shown). The press basket 24 rests on a support which is preferably in the form of an unloading belt 26. The press basket 24 can be raised in order to unload the water-removal press 12.

The laundry centrifuge 13 is provided with a centrifuging drum 27, which can be driven in a rotary manner, in a manner which is known per se. The centrifuging drum 27 which can be driven in a rotary manner is mounted in a liquid-tight housing 28. The centrifuging drum 27 can be driven about a rotation axis 29 which can be pivoted so that the rotation axis 29 runs downward toward the loading side 19 for unloading purposes, while the rotation axis 29 is inclined downward starting from the loading side 19 for loading purposes.

The dryers 14, which are identical in the exemplary embodiment shown, are formed in a manner which is known per se. Dryers of different known designs can serve as dryers.

The lift belt conveyor 20 has a conveyor belt 30 which can be moved upward and downward on an upright pillar 32. The conveying direction of the conveyor belt 30 runs in the direction of the longitudinal center axis 18 between the water-removal press 12 and the laundry centrifuge 13 or the respective dryer 14. A channel 31 is provided by means of the conveyor belt 30, said channel being open to the unloading side 17 of the water-removal press 12 and to the loading side 19 of the laundry centrifuge 13 or the dryers 14. The channel 31 routes or supports the heap of laundry or pile of laundry arriving from the water-removal press 12 on the conveyor belt 30. The lower end of the pillar 32 of the unloading belt 26 is firmly connected to a running gear 33, as a result of which the unloading belt 26 can be moved along the two parallel rails 21, transverse to the longitudinal center axis of the tunnel-type washing machine 10, to the dryers 14.

For reasons of better illustration, FIGS. 1 and 2 show the opposite ends 34 of the conveyor belt 30, which can be driven in reverse in opposite directions, of the lift belt conveyor 20, for the purpose of better identification, at relatively large distances from the unloading side 17 of the water-removal press 12 and the loading side 19 of the laundry centrifuge 13 and the dryers 14. However, the distances are actually smaller, and therefore laundry can be transferred from the water-removal press 12 directly to the conveyor belt 30 of the lift belt conveyor 20, and the laundry centrifuge 13 or the dryers 14 can be loaded with the laundry by the conveyor belt 30, or the laundry can be unloaded onto the conveyor belt 30 by the centrifuge 13 or the dryers 14.

The method according to the invention will be explained below with reference to the above-described inline washing system:

The inline washing system can be used to wash, remove water from and possibly dry various types of items of laundry, specifically primarily flat laundry such as table linen, bed linen and towels, and also all types of items of clothing, primarily including workwear.

The laundry is first washed, rinsed and optionally finished in the tunnel-type washing machine 10. All of these laundry treatments which are carried out in the tunnel-type washing machine 10 are referred to as "washing" in combination. Accordingly, "washing" therefore means all treatments which are performed in the tunnel-type washing machine 10.

The washed laundry leaves the tunnel-type washing machine 10 via the unloading slide 15. In the process, the washed laundry is fed to the water-removal press 12 directly via its loading side 16. The figures in the drawing show, merely for the purpose of better identification, a distance between the tunnel-type washing machine 10 and the water-removal press 12. However, the two parts are actually arranged so close to one another that the laundry can directly enter the press basket 24 of the water-removal press 12 from the unloading slide 15.

According to the invention, water is removed from the laundry either only in the water-removal press 12 or both in the water-removal press 12 and in the laundry centrifuge 13. The manner of water removal selected depends on the type of items of laundry from which water is to be removed, in particular on whether water is to be removed from delicate or less delicate items of laundry.

In the water-removal press 12, water is completely removed from items of laundry which are insensitive to the mechanical loads which are exerted on the laundry in the water-removal press 12. "Complete" removal of water is understood to mean that as much water as possible has been removed from the laundry in the water-removal press 12. In fact, the laundry still contains a small amount of residual moisture after leaving the water-removal press 12, said small amount of residual moisture generally making subsequent drying necessary. If water has been completely removed from the laundry, that is to say as much water as possible has been removed from the laundry, by the water-removal press 12, the laundry from which water has been removed is unloaded onto the following lift belt conveyor 20 via the unloading side 17 of the water-removal press 12. To this end, the conveyor belt 30 of the lift belt conveyor 20 is moved down the pillar 32 to such an extent that the end 34 of the conveyor belt 30 of the lift belt conveyor 20 is located in front of the corresponding end of the unloading belt 26 of the water-removal press 12. The laundry from which water has been removed can then be transferred from the water-removal press 12 directly onto the lift belt conveyor 20.

Since it is no longer necessary to remove more water from the laundry in the laundry centrifuge 13 when water has been completely removed from the laundry in the water-removal press 12, the lift belt conveyor 20 moves the batch of laundry from which water has been removed along the rails 21 to a position in front of the loading side 19 of one of the dryers 14. The respective dryer 14, via the loading side 19, is then loaded with the laundry from which water has been removed solely in the water-removal press 12 via that end 35 of the conveyor belt 30 of the lift belt conveyor 20 which faces the respective dryer 14.

The respective dryer 14 can be unloaded in a different way, for example by transportation systems which are conventional in a laundry. However, it is also feasible to return the dried laundry from the respective dryer 14, via the loading side 19, to the lift belt conveyor 20 by the conveyor belt 30 of the lift belt conveyor 20, for the purpose of unloading the respective dryer 14, being moved downward relative to the loading position of the dryer 14 into a lower-lying unloading position in which the dried laundry from the dryer 14 can be passed to the conveyor belt 30 of the lift belt conveyor 20 solely by the force of gravity. The dried laundry is then fed from the lift belt conveyor 20, for the purpose of further processing within the laundry, for example to an input device in a position in front of a mangle, a storage conveyor or the like.

A variant of the method in which the pile of laundry from which water has been completely removed and which is unloaded from the water-removal press 12 is fed from the lift belt conveyor 20 to a separating device (not shown) is also feasible if drying of the laundry from which water has been completely removed by the water-removal press 12 is not or is no longer necessary.

Water is not completely removed from delicate laundry, such as items of clothing and, in particular, also workwear, in the water-removal press 12 but rather only some water is removed. To this end, delicate laundry is only subjected to preliminary pressing or preliminary water removal in the water-removal press 12. This preliminary pressing or preliminary water removal is performed in such a way that only a pressing force which corresponds to 2% to 15%, in particular 3% to 8%, of the pressing force which is exerted by the water-removal press 12 on the laundry from which water is to be completely removed is exerted on the delicate items of laundry in the water-removal press 12. The laundry which has been subjected only to preliminary pressing is unloaded onto the conveyor belt 30 of the lift belt conveyor 20 via the unloading side 17 of the water-removal press 12. After the lift belt conveyor 20 is loaded with a batch of laundry, the conveyor belt 30 of the lift belt conveyor 20 is moved upward on the pillar 32 of said lift belt conveyor. The conveyor belt 30 is moved upward on the pillar 32 until the laundry centrifuge 13 can be loaded with the laundry, which has been subjected only to preliminary pressing and preliminary water removal, by the force of gravity. To this end, the conveyor belt 30 conveys the batch of laundry to the centrifuging drum 27 of the laundry centrifuge 13 via the end 35 which faces the loading side 19 of the laundry centrifuge 13.

Water is then completely removed from the laundry in the laundry centrifuge 13 by centrifuging. As soon as this has happened, the laundry is also unloaded from the laundry centrifuge 13 by the lift belt conveyor 20. To this end, the conveyor belt 30 is moved downward on the pillar 32 until the laundry can be unloaded from the centrifuging drum 27, which is inclined obliquely downward toward the loading side 19, of the laundry centrifuge 13 onto the conveyor belt 30 of the lift belt conveyor 20 by the force of gravity. The laundry from which water has been completely removed in the laundry centrifuge 13 is then transported by the lift belt conveyor 20, which can be moved on the rails 21, to a laundry device (not shown) for further processing. Said laundry device may be a finisher in the case of items of clothing.

As an alternative, it is also feasible to unload the laundry centrifuge 13 without the aid of the lift belt conveyor 20 but rather to feed the items of laundry to other transportation means which are present in a laundry. This is primarily the case when provision is made, as an alternative, for the items of laundry to be unloaded on an unloading side which is opposite the loading side 19.

On account of the above-described selective removal of water from the items of laundry in only the water-removal press 12 or both in the water-removal press 12 and in the laundry centrifuge 13, the water-removal press 12 can remain behind the tunnel-type washing machine 10 for all the items of laundry which are to be washed in the tunnel-type washing machine 10, in particular delicate and hard-wearing items of laundry, because the laundry, even delicate items of laundry, always runs or passes through the water-removal press 12. Only a comparatively low pressing force is applied to delicate items of laundry in the water-removal press 12, and therefore said delicate items of laundry are only subjected to preliminary pressing or preliminary water removal in the water-removal press 12. Water is ultimately removed from delicate items of laundry in the laundry centrifuge 13 which follows the water-removal press 12. In this case, the lift belt conveyor 20 serves as a linking element, in particular as a connecting conveyor, between the water-removal press 12 and the laundry centrifuge 13 which follows it. However, the lift belt conveyor 20 also has a switching function since it feeds the laundry arriving from the water-removal press 12 to the laundry centrifuge 13 or to the respective dryer 14, depending on whether water has been completely removed from said laundry or said laundry has been subjected only to preliminary water removal.

LIST OF REFERENCES SYMBOLS

10 Tunnel-type washing machine
11 Treatment direction
12 Water-removal press
13 Laundry centrifuge
14 Dryer
15 Unloading slide
16 Loading side
17 Unloading side
18 Longitudinal center axis
19 Loading side
20 Lift belt conveyor
21 Rail
22 Drum
23 Chamber
24 Press basket
25 Ram
26 Unloading belt
27 Centrifuging drum
28 Housing
29 Rotation axis
30 Conveyor belt
31 Channel
32 Pillar
33 Running gear
34 End
35 End

What is claimed is:

1. A method for treating laundry, comprising:

at least washing the laundry in an apparatus comprising a washing machine, a water-removal press, and a laundry centrifuge;

removing at least some water from the laundry in a subsequent water-removal process selected from the group consisting of (a) the water-removal press (12) and (b) the water-removal press (12) and subsequent laundry centrifuge (13); and selecting between the two different water removal processes for removing water from the laundry, wherein the water removal process is selected depending upon whether water is being removed from delicate items of laundry or from less delicate items of laundry, whereas in the case of less delicate items of laundry water is removed only by the water-removal press (12) and in the case of delicate items of laundry water is removed in the water-removal press (12) and then in the laundry centrifuge (13).

2. The method as claimed in claim 1, further comprising:

when water is removed from the laundry only in the water-removal press (12), applying a maximum pressing force to the laundry in the water-removal press (12), wherein the maximum pressing force is the force needed to remove water from the laundry and is applied to the laundry when water is removed from the laundry only in the water-removal press; and when water is removed from the laundry both in the water-removal press (12) and in the laundry centrifuge (13), applying only a reduced pressing force to the laundry in the water-removal press (12).

3. The method as claimed in claim 1, further comprising, if water is removed from the laundry both in the water-removal press (12) and in the laundry centrifuge (13), subjecting the laundry to preliminary water removal in the water-removal press (12).

4. The method as claimed in claim 3, further comprising, if water is removed from the laundry in the water-removal press (12) and the laundry centrifuge (13), subjecting the laundry to preliminary water removal only at from 2 % to 15 % of the maximum pressing force in the water-removal press (12).

5. The method as claimed in claim 3, further comprising, if water is removed from the laundry in the water-removal press (12) and the laundry centrifuge (13), subjecting the laundry to preliminary water removal only at from 3 % to 8 % of the maximum pressing force in the water-removal press (12).

6. The method as claimed in claim 3, further comprising removing more water from the laundry in the laundry centrifuge (13).

7. The method as claimed in claim 1, further comprising, if water is removed from the laundry both in the water-removal press (12) and in the laundry centrifuge (13), subjecting the laundry to preliminary pressing in the water-removal press (12).

8. The method as claimed in claim 1, wherein the maximum amount of water is removed from the laundry in the laundry centrifuge (13).

9. The method as claimed in claim 1, further comprising processing the laundry further without being dried after water has been removed from said laundry in the laundry centrifuge (13).

10. The method as claimed in claim 1, further comprising drying the laundry in a dryer (14) after water has been removed from said laundry only in the water-removal press (12).

11. The method as claimed in claim 1, further comprising transferring the laundry by at least one shuttle from the water-removal press (12) selectively to the laundry centrifuge (13) or to at least one dryer (14).

12. The method as claimed in claim 11, further comprising unloading the laundry from the water-removal press (12) into the at least one shuttle, and selectively loading the laundry centrifuge (13) or the dryer (14) by the at least one shuttle.

* * * * *